US010784626B2

(12) United States Patent
Chen et al.

(10) Patent No.: US 10,784,626 B2
(45) Date of Patent: Sep. 22, 2020

(54) ELECTRICAL CONNECTOR

(71) Applicant: SPEED TECH CORP., Taoyuan (TW)

(72) Inventors: Li-Sen Chen, Taoyuan (TW); Cheng-Hsiang Hsueh, Taoyuan (TW); Ken Hsieh, Taoyuan (TW)

(73) Assignee: SPEED TECH CORP., Taoyuan (TW)

( * ) Notice: Subject to any disclaimer, the term of this patent is extended or adjusted under 35 U.S.C. 154(b) by 0 days.

(21) Appl. No.: 16/699,909

(22) Filed: Dec. 2, 2019

(65) Prior Publication Data

US 2020/0176929 A1 Jun. 4, 2020

(30) Foreign Application Priority Data

Dec. 3, 2018 (TW) ..... 107143283 A

(51) Int. Cl.
*H01R 13/639* (2006.01)
*H01R 13/646* (2011.01)

(52) U.S. Cl.
CPC ..... *H01R 13/639* (2013.01); *H01R 13/646* (2013.01)

(58) Field of Classification Search
CPC .... H01R 16/4361; H01R 16/639; H01R 9/05; H01R 9/0518; H01R 24/38
USPC ..... 439/347, 578
See application file for complete search history.

(56) References Cited

U.S. PATENT DOCUMENTS

| | | | | |
|---|---|---|---|---|
| 5,647,757 | A * | 7/1997 | Chrysostomou | H01R 13/6271 439/188 |
| 7,892,028 | B2 * | 2/2011 | Wu | H01R 9/05 439/607.28 |
| 8,939,794 | B2 * | 1/2015 | Mason | H01R 13/6275 439/581 |
| 9,425,564 | B2 * | 8/2016 | Yamaguchi | H01R 13/6592 |
| 9,502,834 | B2 | 11/2016 | Hashimoto | |
| 10,389,069 | B2 * | 8/2019 | Yamauchi | H01R 13/432 |

* cited by examiner

*Primary Examiner* — Hien D Vu
(74) *Attorney, Agent, or Firm* — Birch, Stewart, Kolasch & Birch, LLP

(57) ABSTRACT

An electrical connector includes a plug and a sliding lock element. The plug includes an inserting portion, a cover portion, and a first sidewall portion. The cover portion covers one end of the inserting portion. The first sidewall portion is perpendicularly connected to the cover portion. A gap is formed between the first sidewall portion and the inserting portion. The sliding lock element is assembled on the plug. The sliding lock element includes a lid portion, a vertical extension portion, and a fitting portion. The lid portion slidably covers the cover portion of the plug. The vertical extension portion is perpendicularly connected to the lid portion. The fitting portion is connected to the vertical extension portion and extends toward the lid portion.

9 Claims, 14 Drawing Sheets

P1

P2

P2

ELECTRICAL CONNECTOR

CROSS-REFERENCE TO RELATED APPLICATION

This application claims priority to Taiwan Application Serial Number 107143283, filed Dec. 3, 2018, which is herein incorporated by reference in its entirety.

BACKGROUND

Field of Invention

The present invention relates to an electrical connector. More particularly, the present invention relates to a high frequency electrical connector.

Description of Related Art

Due to the rapid development of communication technology, various electronic communication products have been widely used. In addition, to transmit a large amount of data more quickly, the transmission signal specification has been trending to higher frequencies. In order to transmit high-frequency signal data between different electronic products, an electrical connector has become one of the indispensable components in the electronic products.

The electrical connector can be made in a variety of different types to accommodate different requirements of a variety of transmission media, such as interface card connectors, network routing connectors, coaxial cable connectors, telephone line connectors, optic fiber connectors and so on. In practical applications, the electrical connector is often fabricated in a form of a plug. The signal connector of the device is made into a socket type to facilitate the coupling with the electrical connector and to fulfill the signal transmission.

Generally, the electrical connector is fixed to the socket by a clamping force of the plug itself, or the electrical connector is fixed to the socket by screwing. However, by the method of the clamping force, the clamping force of the plug is gradually weakened and the plug is easily loosened from the socket after repeated insertion and removal. Therefore, the signal transmission cannot be operated normally. On the other hand, with the screw locking method, the user needs to spend more time to lock the screw which is not convenient for the user to assemble the socket and the plug.

Accordingly, how to provide an electrical connector to solve the aforementioned problems becomes an important issue to be solved by those in the industry.

SUMMARY

The invention provides an electrical connector that is easy to be assembled to a receptacle connector and a plug of the electrical connector can be securely coupled to the receptacle connector.

According to an embodiment of the disclosure, the electrical connector includes a plug and a sliding lock element. The plug includes an inserting portion, a cover portion, and a first sidewall portion. The inserting portion is shaped as a cylindrical. The cover portion covers one end of the inserting portion. The first sidewall portion is perpendicularly connected to the cover portion. A gap is formed between the first sidewall portion and the inserting portion. The sliding lock element is assembled on the plug. The sliding lock element includes a lid portion, a vertical extension portion, and a fitting portion. The lid portion slidably covers the cover portion of the plug. The vertical extension portion is perpendicularly connected to the lid portion. The fitting portion is connected to the vertical extension portion and extends toward the lid portion. When the fitting portion slides with the lid portion to a first position relative to the plug, the fitting portion is fitted in the gap between the inserting portion and the first sidewall portion.

In an embodiment of the disclosure, the first sidewall portion includes a guiding slot.

In an embodiment of the disclosure, the sliding lock element further includes a first stopping portion. The first stopping portion is disposed on the vertical extension portion. The first stopping portion slides along the guiding slot of the first sidewall portion. When the fitting portion slides with the lid portion to a second position relative to the plug, the first stopping portion is abutted against an end surface of the guiding slot.

In an embodiment of the disclosure, the plug further includes a second sidewall portion. The second sidewall portion is perpendicularly connected to the cover portion. A distance from the second sidewall portion to a central line of the cover portion is smaller than a distance from the first sidewall portion to the central line of the cover portion.

In an embodiment of the disclosure, the sliding lock element further includes a connected portion. The connected portion is connected between the vertical extension portion and the fitting portion.

In an embodiment of the disclosure, the connected portion is a U-shaped structure.

In an embodiment of the disclosure, the sliding lock element further includes a second stopping portion. The second stopping portion is perpendicularly connected to the vertical extension portion. When the sliding lock element is positioned at the first position, the second stopping portion is abutted against the inserting portion.

In an embodiment of the disclosure, an end of the inserting portion away from the cover portion includes a plurality of notches.

In an embodiment of the disclosure, the electrical connector is a high frequency electrical connector.

In an embodiment of the disclosure, the plug is configured to be located at an end of a cable. The sliding lock element slides along a direction that deviates from an axis of the cable with a predetermined angle.

Accordingly, in the electrical connector of the present disclosure, a diameter expansion capability of the inserting portion of the plug is restricted or is loosen by the sliding of the fitting portion of the sliding lock element. Therefore, the plug of the electrical connector can be quickly and easily assembled to the receptacle connector, and the plug is tightly engaged to the receptacle connector.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
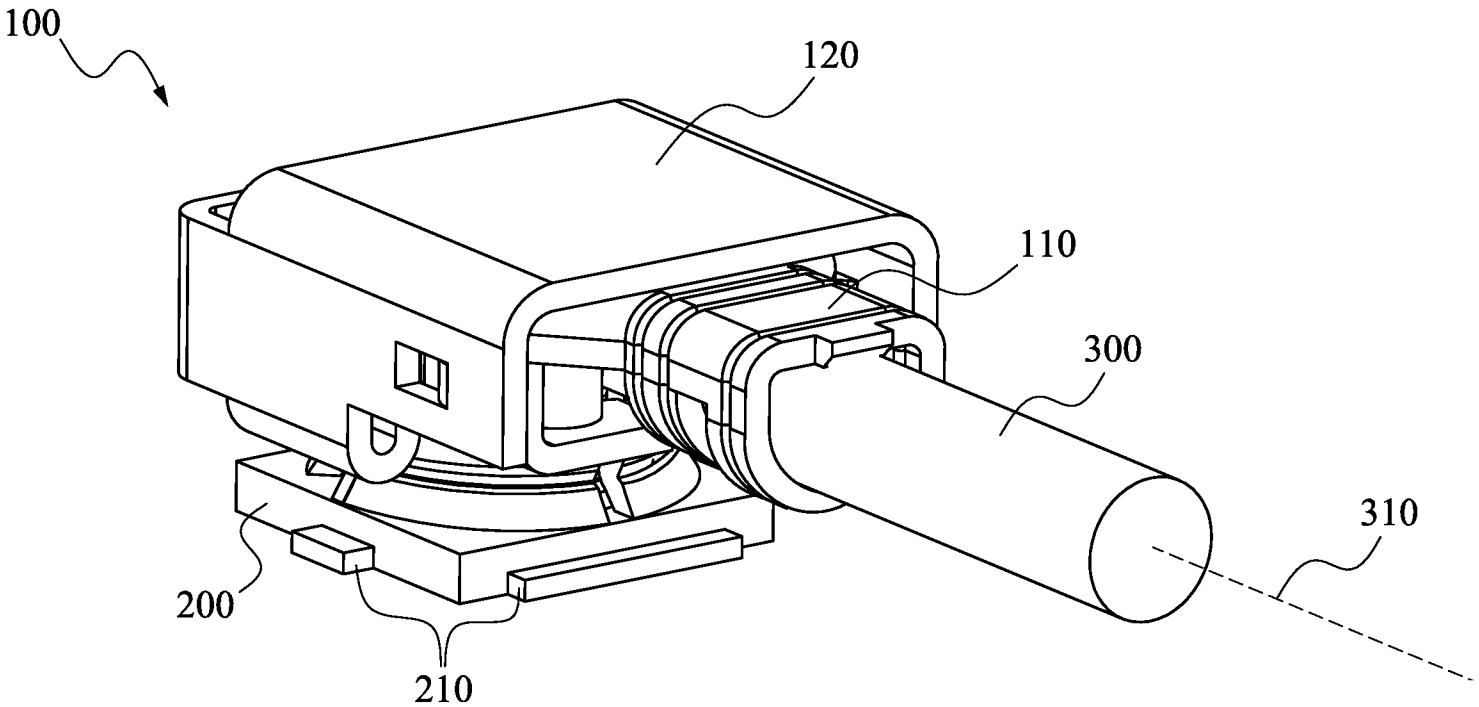
FIG. 1 is a perspective view of an electrical connector and a receptacle connector according to an embodiment of the disclosure.

Reference will now be made in detail to the present embodiments of the invention, examples of which are illustrated in the accompanying drawings. Wherever possible, the same reference numbers are used in the drawings and the description to refer to the same or like parts.

In addition, terms used in the specification and the claims generally have the usual meaning as each terms are used in the field, in the context of the disclosure and in the context of the particular content unless particularly specified. Some terms used to describe the disclosure are to be discussed below or elsewhere in the specification to provide additional guidance related to the description of the disclosure to specialists in the art.

Phrases "first," "second," etc., are solely used to separate the descriptions of elements or operations with same technical terms, not intended to be the meaning of order or to limit the invention.

Secondly, phrases "comprising," "includes," "provided," and the like, used in the context are all open-ended terms, i.e. including but not limited to.

Further, in the context, "a" and "the" can be generally referred to one or more unless the context particularly requires. It will be further understood that phrases "comprising," "includes," "provided," and the like, used in the context indicate the characterization, region, integer, step, operation, element and/or component it stated, but not exclude descriptions it stated or additional one or more other characterizations, regions, integers, steps, operations, elements, components and/or groups thereof.

Reference is made to FIG. 1. FIG. 1 is a perspective view of an electrical connector 100 and a receptacle connector 210 according to an embodiment of the disclosure. As shown in FIG. 1, the electrical connector 100 includes a plug 110 and a sliding lock element 120. A substrate 200 includes the receptacle connector 210. The plug 110 of the electrical connector 100 has a conducting contact therein for being electrically connected to a conducting contact in the receptacle connector 210. An engagement of the plug 110 and the receptacle connector 210 will be described in further detail in the description below.

The sliding lock element 120 is mounted on the plug 110. The sliding lock element 120 is slidable relative to the plug 110. Specifically, the electrical connector 100 is a connector that electrically connects a cable-like signal transmission medium to a circuit on the substrate 200. The cable-like signal transmission medium refers to a medium that emits signals transmitted by various electronic devices such as mobile phones. In the embodiment, the cable-like signal transmission medium can be, for example, a coaxial cable 300, but the disclosure should not be limited in this regard. The plug 110 is mounted to one end of the coaxial cable 300. The sliding lock element 120 slides along a direction that angles a predetermined angle relative to an axis 310 of the coaxial cable 300. In the embodiment, the predetermined angle can be, for example, 0 degree. That is, the sliding lock element 120 slides relative to the plug 110 along the axial direction of the coaxial cable 300. However, the disclosure should not be limited in this regard.

In some embodiments, the electrical connector 100 is a radio frequency high frequency connector, and the substrate 200 is a printed circuit board. However, the disclosure should not be limited in this regard.

In some embodiments, the sliding lock element 120 is an iron piece, a stainless steel piece, or other metal members. However, the disclosure should not be limited in this regard.

Figure 2A:
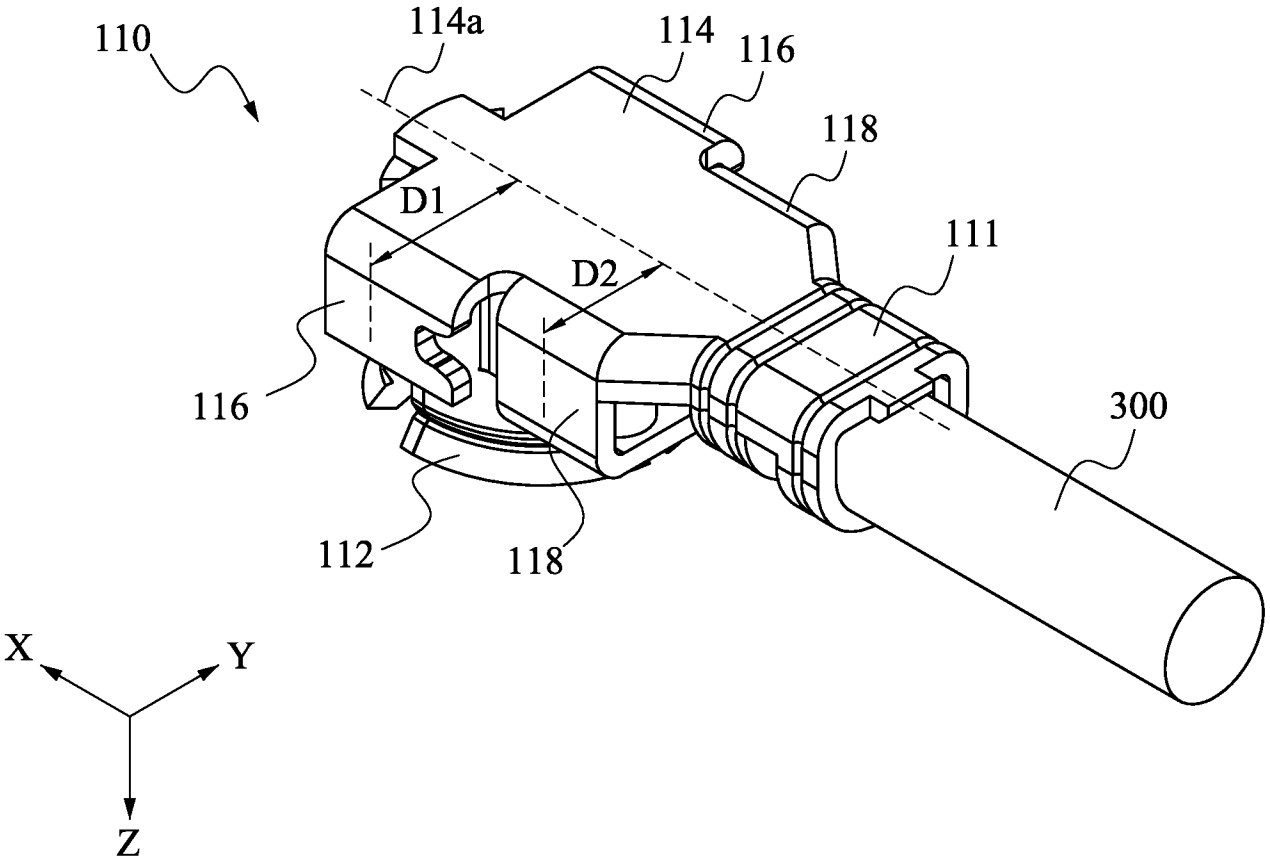
FIG. 2A is a perspective view of a plug in FIG. 1.

Reference is made to FIG. 2A. FIG. 2A is a perspective view of the plug 110 in FIG. 1. As shown in FIG. 2A, the plug 110 includes an inserting portion 112, a cover portion 114, two first sidewall portions 116, two second sidewall portions 118, and a fixing portion 111. The cover portion 114 covers an end of the inserting portion 112. The first sidewall portions 116 are respectively and perpendicularly connected to two sides of the cover portion 114. The first sidewall portions 116 extend along a direction Z in FIG. 2A. The second sidewall portions 118 are also respectively and perpendicularly connected to two sides of the cover portion 114, and the second sidewall portions 118 are distanced from the first sidewall portions 116.

Further, a distance D2 from any one of the second sidewall portions 118 to a central line 114*a* of the cover portion 114 is smaller than a distance D1 from any one of the first sidewall portions 116 to the central line 114*a* of the cover portion 114. As such, when the sliding lock element 120 is positioned at a first position P1, two first stopping portions 121 of the sliding lock element 120 can be prevented from interfering with the second sidewall portions 118. The first stopping portions 121 and the first position P1 of the sliding lock element 120 will be described in further detail below. The fixing portion 111 is connected to the cover portion 114 and extends along the coaxial cable 300. Moreover, the fixing portion 111 is coated on an outer circumference of the coaxial cable 300 to fix the coaxial cable 300 to the plug 110.

Figure 2B:
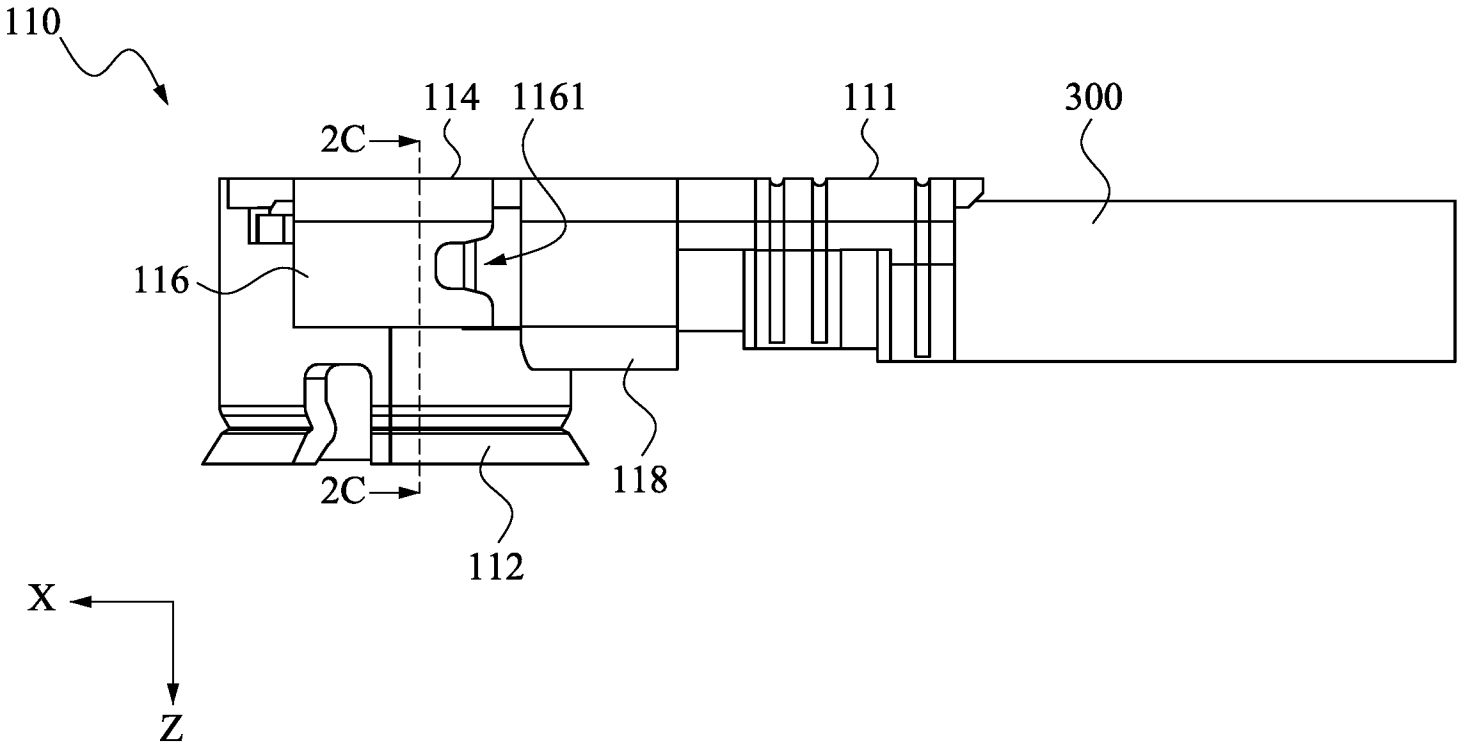
FIG. 2B is a side view of the plug in FIG. 2A.

Reference is made to FIG. 2B. FIG. 2B is a side view of the plug 110 in FIG. 2A. As shown in FIG. 2B, each of the first sidewall portions 116 has a guiding slot 1161. The guiding slots 1161 extend along a direction X in FIG. 2B.

Figure 2C:
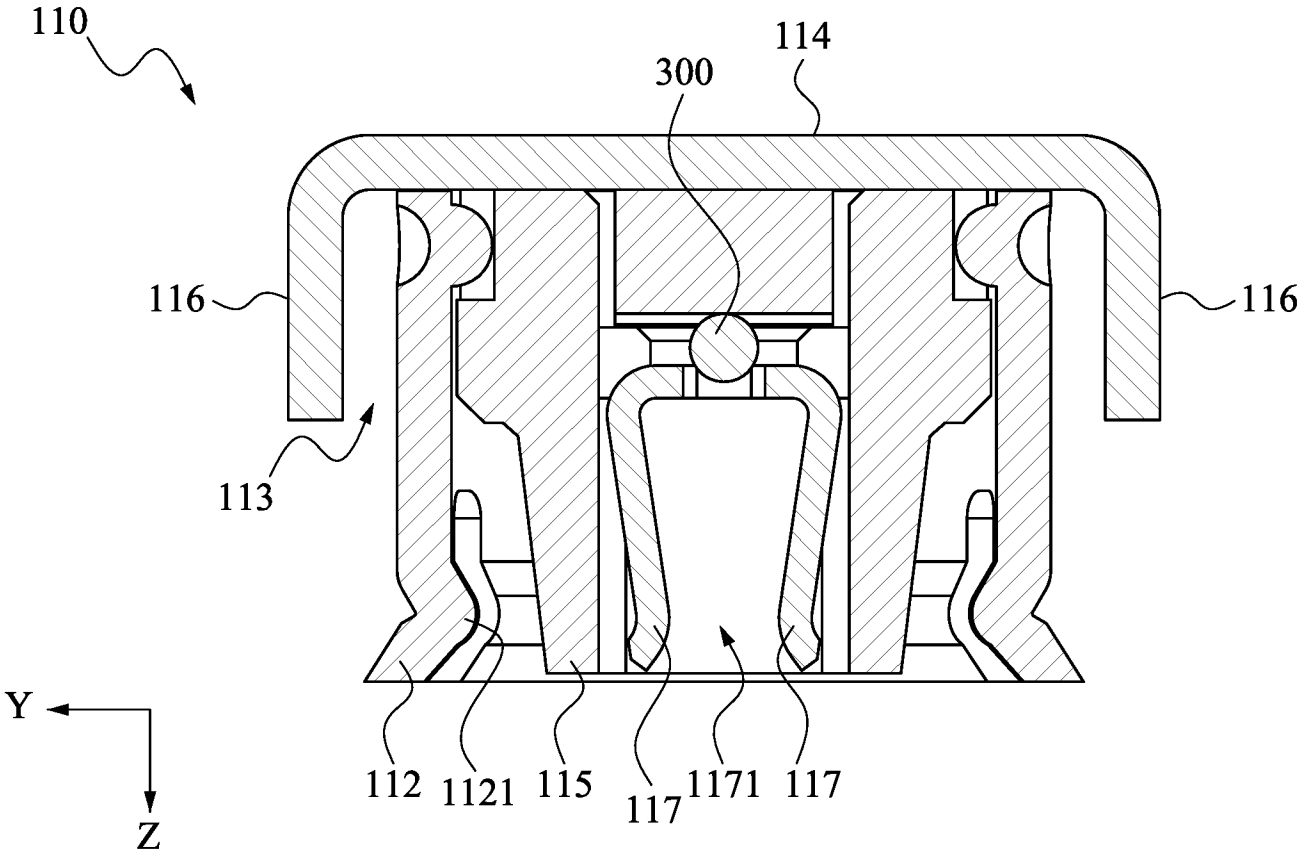
FIG. 2C is a cross-sectional view of the plug taken along line 2C-2C in FIG. 2B.

Reference is made to FIG. 2C. FIG. 2C is a cross-sectional view of the plug 110 taken along line 2C-2C in FIG. 2B. As shown in FIG. 2C, a gap 113 is formed between the inserting portion 112 and the each first sidewall portion 116. The inserting portion 112 is shaped as a cylindrical structure in which the direction Z is an axial direction. The inserting portion 112 is composed of a resilient conductive material. Accordingly, when the plug 110 is inserted into the receptacle connector 210, an outer diameter of the inserting portion 112 can be elastically deformed to expand outward. For example, the inserting portion 112 has the outer diameter of about 2.5 mm in an unexpanded state. In an expanded state, the outer diameter of the inserting portion 112 is about 2.7 mm, but the disclosure should not be limited in this regard. Further an inner circumferential surface of the inserting portion 112 has a convex portion 1121. The convex portion 1121 protrudes toward an inner space surrounded by the inserting portion 112. The convex portion 1121 extends around the inner circumferential surface of the inserting portion 112.

In some embodiments, a number of the convex portion 1121 is plural. The plurality of convex portion 1121 are disposed at intervals on the inner circumferential surface of the inserting portion 112. However, the disclosure is not limited in this regard.

Continue to refer to FIG. 2C. The plug 110 further includes an insulating portion 115 and a conductive contact 117. The conductive contact 117 is made of conductive material. The conductive contact 117 is disposed inside the inserting portion 112. The conductive contact 117 is electrically coupled to the coaxial cable 300 to form a part of a signal transmission circuit. The conductive contact 117 extends from a connection with the coaxial cable 300 toward the direction Z to form an accommodating space 1171. The insulating portion 115 is disposed between the inserting portion 112 and the conductive contact 117. Since the inserting portion 112 and the conductive contact 117 are two different electrodes of the electrical connector 100 respectively, the insulating portion 115 is used to ensure an insulated state between the conductive contact 117 and the inserting portion 112, so as to avoid electrical interference between the inserting portion 112 and the conductive contact 117.

Figure 2D:
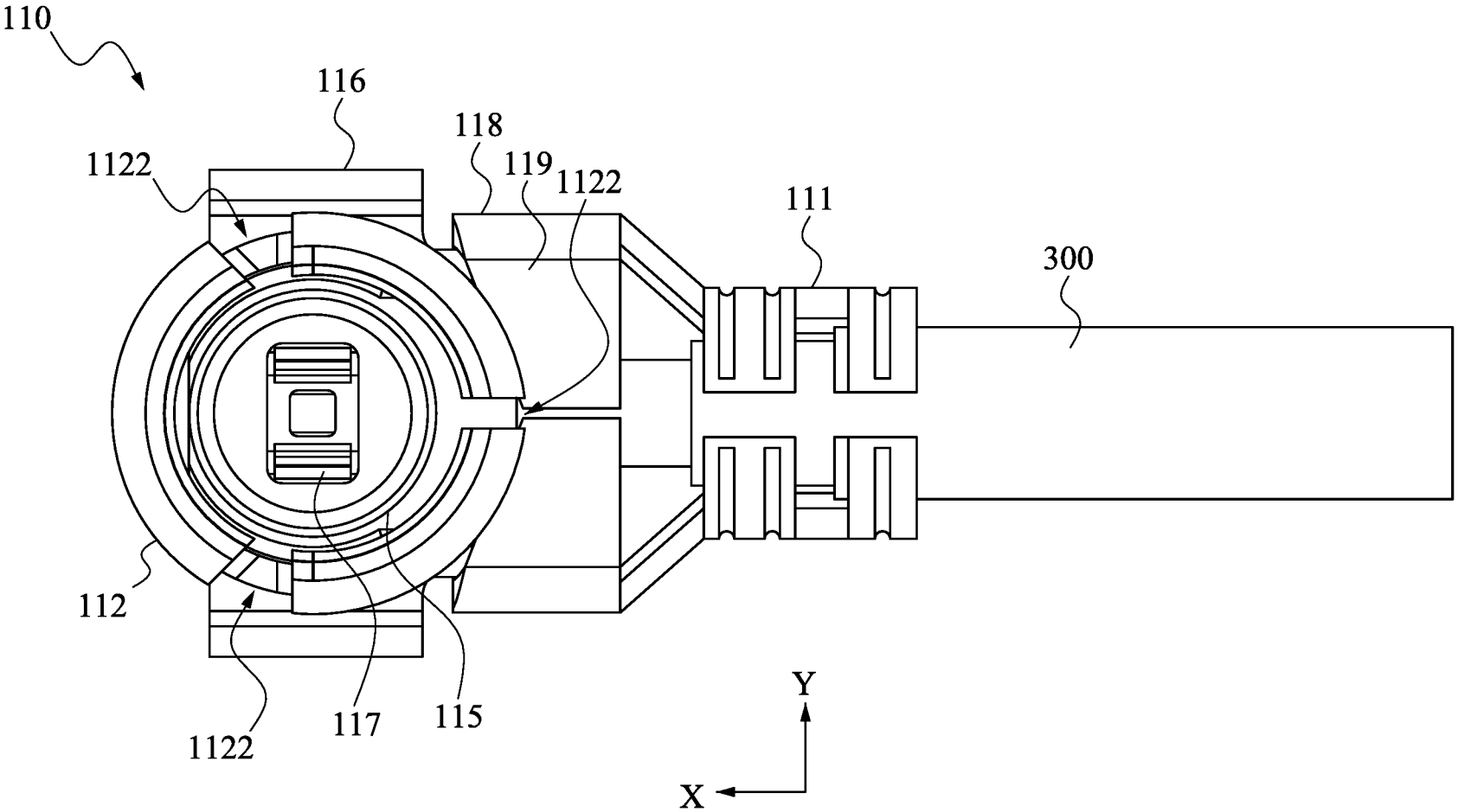
FIG. 2D is a bottom view of the plug in FIG. 2A.

Reference is made to FIG. 2D. FIG. 2D is a bottom view of the plug 110 in FIG. 2A. As shown in FIG. 2D, an end of the inserting portion 112 away from the cover portion 114 includes three notches 1122. When the plug 110 is inserted into the receptacle connector 210, the notches 1122 can accommodate an expansion requirement of the inserting portion 112. The plug 110 further includes two shrouding portions 119. The shrouding portions 119 are connected to the second sidewall portions 118 respectively and bend relative to the second sidewall portions 118. The shrouding portions 119 extend along a direction parallel to a direction Y to cover the coaxial cable 300. The shrouding portions 119 can protect the coaxial cable 300 from being damaged by colliding of objects. Also, the shrouding portions 119 can assist the fixing portion 111 to clamp and to fix the coaxial cable 300.

In some embodiments, a number and shape of the notches 1122 of the inserting portion 112 can be adjusted according to actual needs. The disclosure should not be limited in FIG. 2D.

Overall, the inserting portion 112, the cover portion 114, the first sidewall portions 116, the second sidewall portions 118, and the fixing portion 111 together form an outer conductive case. The outer conductive case is electrically connected to the coaxial cable 300 by the fixing portion 111 to constitute a part of the ground circuit.

Figure 3B:
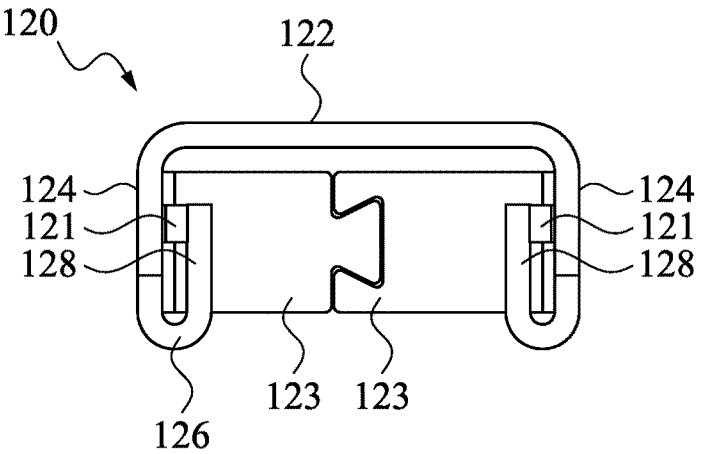
FIG. 3B is a rear view of the sliding lock element in FIG. 3A.
Figure 3A:
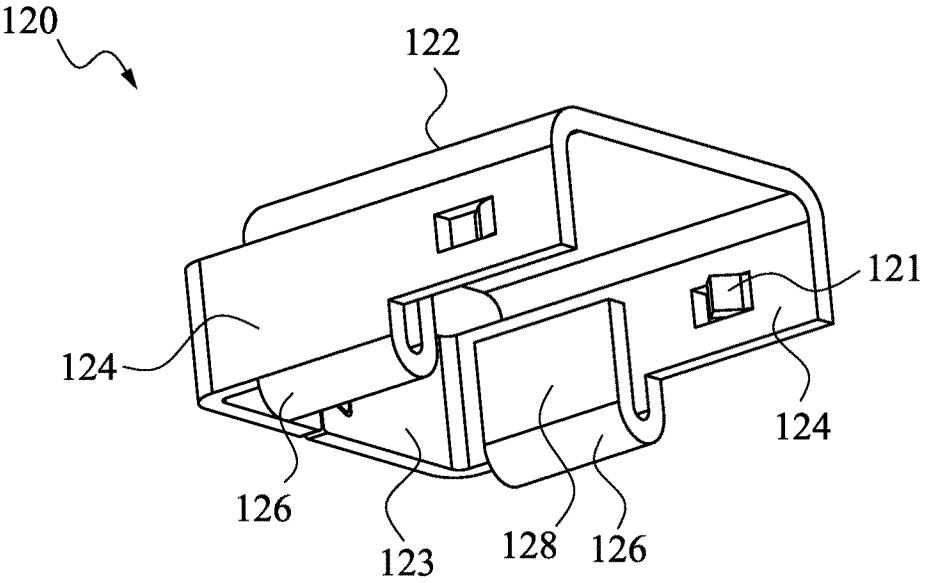
FIG. 3A is a perspective view of a sliding lock element in FIG. 1.

Reference is made to FIG. 3A. FIG. 3A is a perspective view of a sliding lock element 120 in FIG. 1. As shown in FIG. 3A, the sliding lock element 120 includes a lid portion 122, two vertical extension portions 124, two connected portions 126, two fitting portions 128, and the two first stopping portions 121. The vertical extension portions 124 are perpendicularly connected to the lid portions 122. The fitting portions 128 are connected to the vertical extension portions 124 by the connected portions 126 respectively. Specifically, the connected portions 126 extend toward a space surrounded by the lid portion 122 and the vertical extension portions 124 relative to the vertical extension portions 124. As such, the fitting portions 128 are disposed between the vertical extension portions 124 on two sides of the lid portion 122. Further, the each fitting portion 128 extends toward the lid portion 122 and faces to the corresponding vertical extension portion 124. The first stopping portions 121 are disposed on the vertical extension portions 124 respectively. The first stopping portions 121 extend toward the space surrounded by the lid portion 122 and the vertical extension portions 124 relative to the vertical extension portions 124.

In the embodiment, the connected portions 126 are U-shaped structures. In some embodiments, the connected portions 126 are plate-like structures connected between the vertical extension portions 124 and the fitting portions 128. However, the disclosure should not be limited in this regard.

Reference is made to FIG. 3B. FIG. 3B is a rear view of the sliding lock element 120 in FIG. 3A. As shown in FIG. 3B, the sliding lock element 120 further includes a second stopping portion 123. The second stopping portion 123 is perpendicularly connected to two ends of the vertical extension portions 124, and the lid portion 122 extends between the vertical extension portions 124. Each of the fitting portions 128 is positioned between the corresponding first stopping portion 121 and the second stopping portion 123. Each of the fitting portions 128 is distanced from the corresponding first stopping portion 121 and the second stopping portion 123, as shown in FIG. 3A.

Figure 4A:
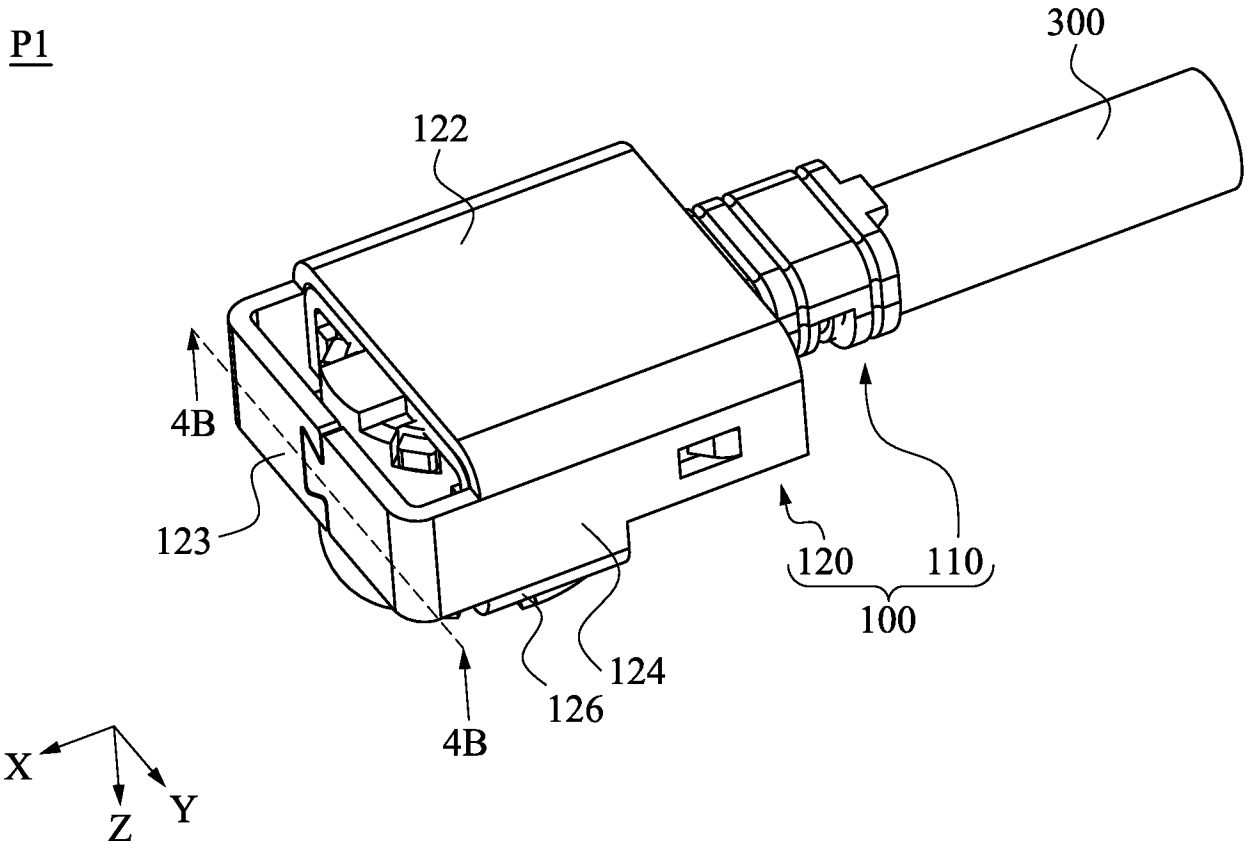
FIG. 4A is a perspective view of the electrical connector when the sliding lock element is at a first position according to an embodiment of the disclosure.
Figure 4B:
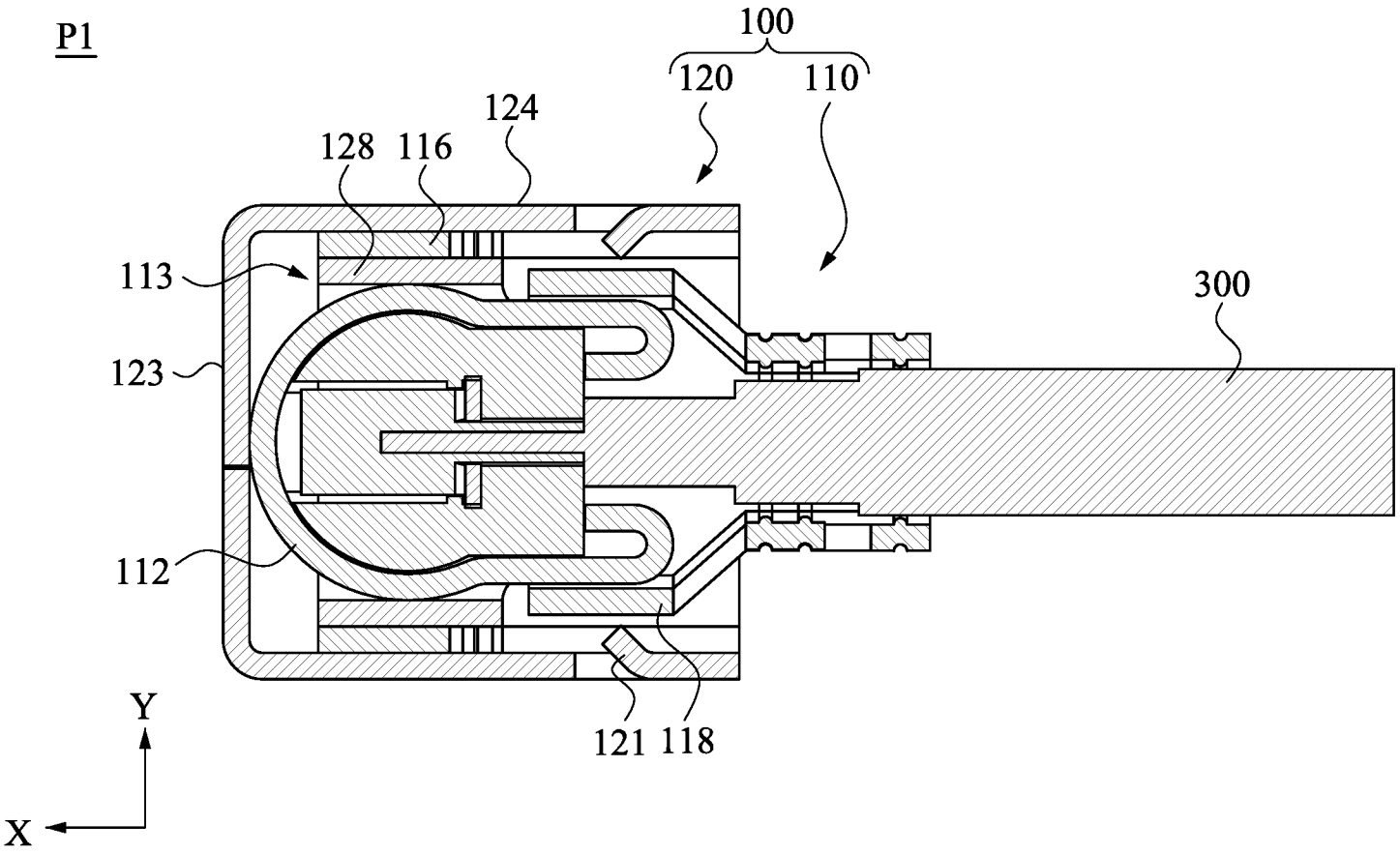
FIG. 4B is a cross-sectional view of the electrical connector taken along line 4B-4B in FIG. 4A.
Figure 5A:
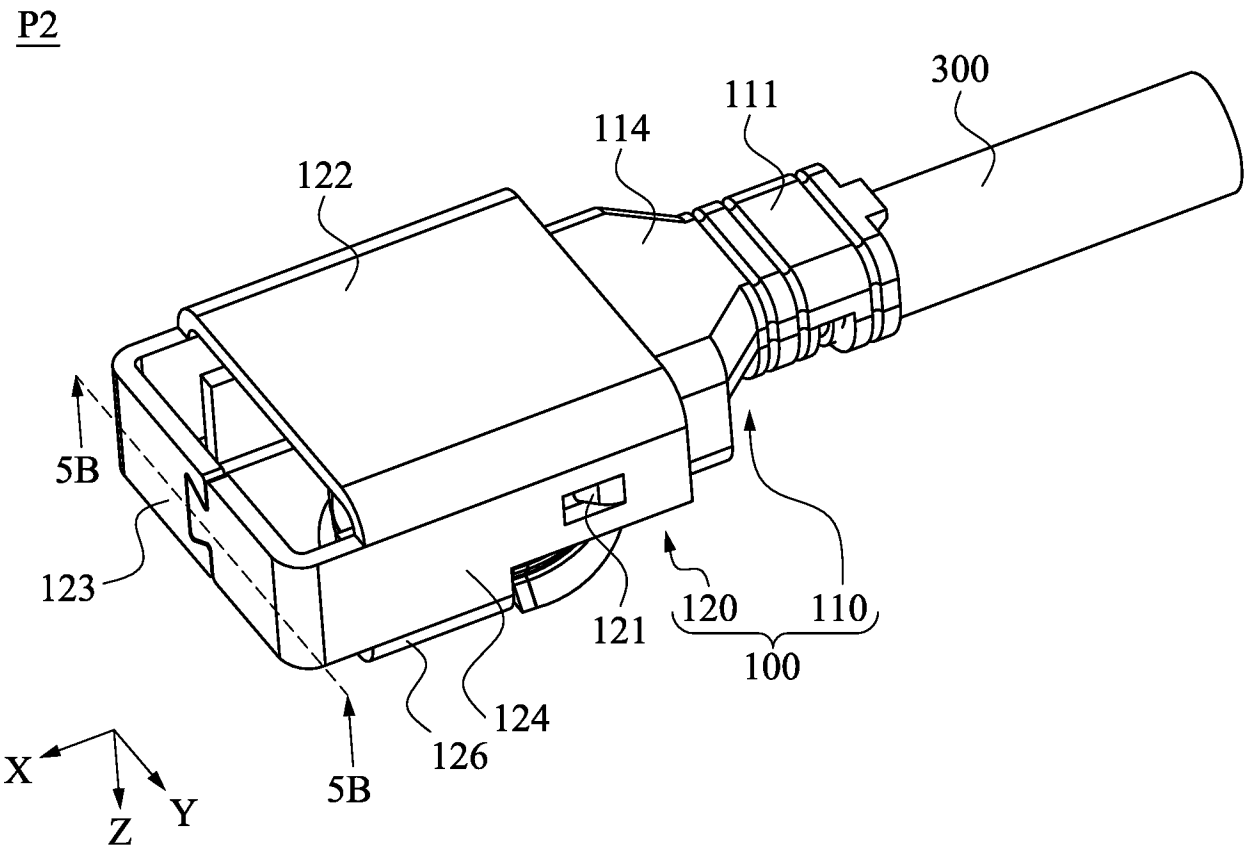
FIG. 5A is a perspective view of the electrical connector when the sliding lock element is at a second position according to an embodiment of the disclosure.
Figure 5B:
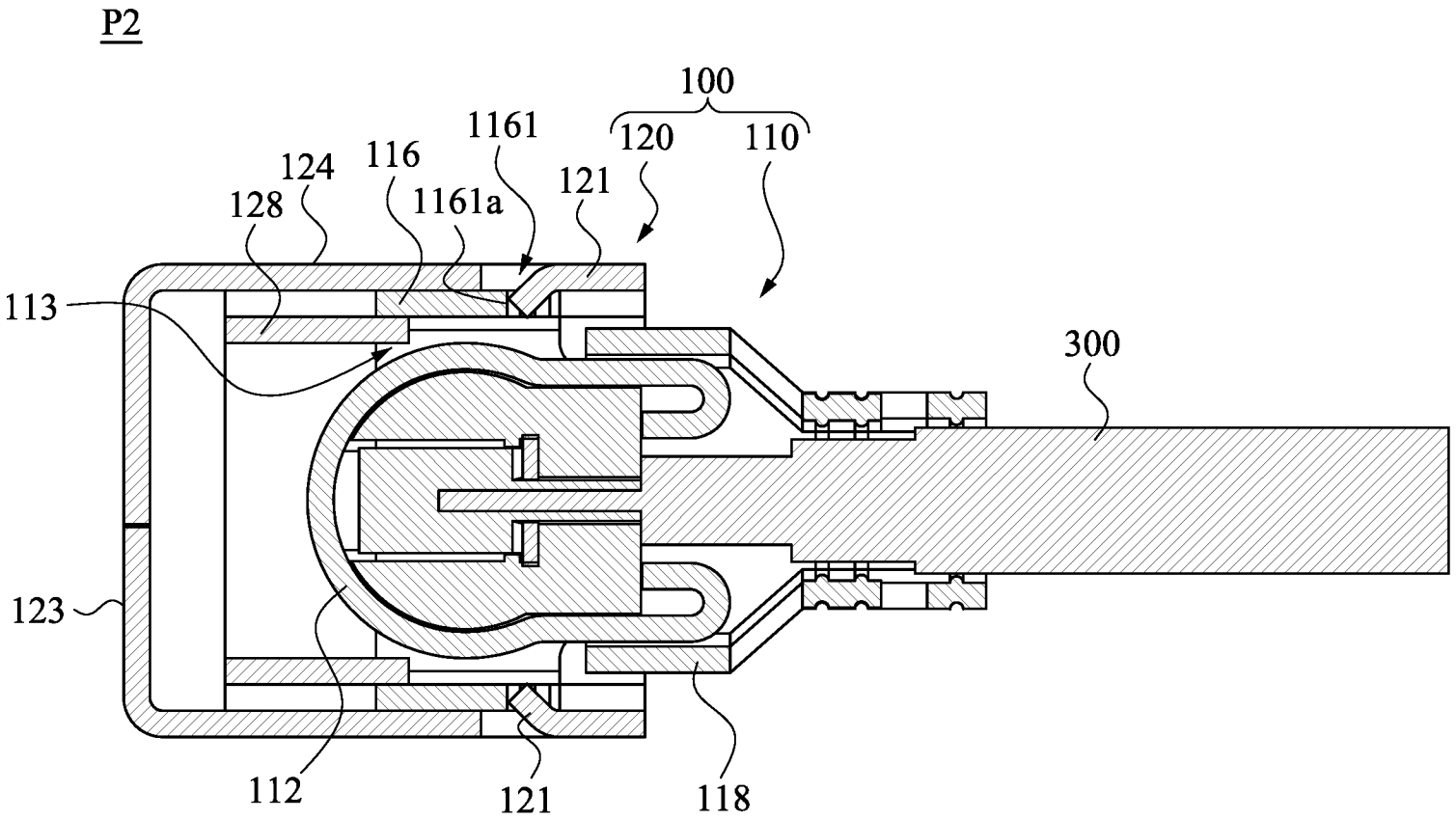
FIG. 5B is a cross-sectional view of the electrical connector taken along line 5B-5B in FIG. 5A.

Reference is made to FIGS. 4A and 4B. FIG. 4A is a perspective view of the electrical connector 100 when the sliding lock element 120 is at a first position P1 according to an embodiment of the disclosure. FIG. 4B is a cross-sectional view of the electrical connector 100 taken along line 4B-4B in FIG. 4A. As shown in FIG. 4A, the sliding lock element 120 is mounted on the plug 110. The lid portion 122 of the sliding lock element 120 slidably covers the cover portion 114 of the plug 110. In other words, the sliding lock element 120 is slidable relative to the plug 110 to switch between the first position P1 and a second position P2, as shown in FIGS. 5A and 5B. When the sliding lock element 120 is positioned at the first position P1, the sliding lock element 120 limits the diameter expansion of the inserting portion 112. Specifically, as shown in FIG. 4B, when the fitting portions 128 slide with the lid portion 122 to the first position P1 relative to the plug 110, the each fitting portion 128 is fitted into the corresponding gap 113 between the corresponding first sidewall portion 116 and the inserting portion 112. The fitting portions 128 are abutted against the inserting portion 112. The outer diameter of the inserting portion 112 is sandwiched by the fitting portions 128 on two sides, and the capability of the diameter expansion of the inserting portion 112 is thus limited.

Further, when the sliding lock element 120 is located at the first position P1, the second stopping portion 123 of the sliding lock element 120 is abutted against the inserting portion 112 to prevent the fitting portions 128 from sliding out of the gaps 113 between the inserting portion 112 and the first sidewall portions 116 along the direction X. The each connected portion 126 envelopes an end of the corresponding first sidewall portion 116 away from the cover portion 114 to prevent the sliding lock element 120 from detaching from the plug 110 along the direction Z.

Reference is made to FIGS. 5A and 5B. FIG. 5A is a perspective view of the electrical connector 100 when the sliding lock element 120 is at the second position P2 according to an embodiment of the disclosure. FIG. 5B is a cross-sectional view of the electrical connector 100 taken along line 5B-5B in FIG. 5A. As shown in FIG. 5A, the sliding lock element 120 slides from the first position P1 to the second position P2 relative to the cover portion 114 of the plug 110 along the direction X. When the sliding lock element 120 is located at the second position P2, the capability of the diameter expansion of the inserting portion 112 is not limited by the sliding lock element 120. As shown in FIG. 5B, when the fitting portions 128 slide with the lid portion 122 to the second position P2 relative to the plug 110, the fitting portions 128 exit the gaps 113 between the inserting portion 112 and the first sidewall portions 116. The gaps 113 on the two sides of the inserting portion 112 are emptied out, and thus the inserting portion 112 can freely expand.

Moreover, when the sliding lock element 120 is located at the second position P2, each of the first stopping portions 121 of the sliding lock element 120 is abutted against the corresponding end surface 1161*a* of the corresponding guiding slot 1161. Specifically, in the process of sliding the sliding lock element 120 from the first position P1 to the second position P2, each of the first stopping portions 121 of the sliding lock element 120 enters the corresponding guiding slot 1161 of the corresponding first sidewall portion 116, and each of the first stopping portions 121 slides along the corresponding guiding slot 1161. When the sliding lock element 120 slides to the second position P2, the first stopping portions 121 are abutted against the end surfaces 1161*a* of the guiding slots 1161 to prevent the sliding lock element 120 from being separated from the plug 110 along the direction Z.

Figure 6A:
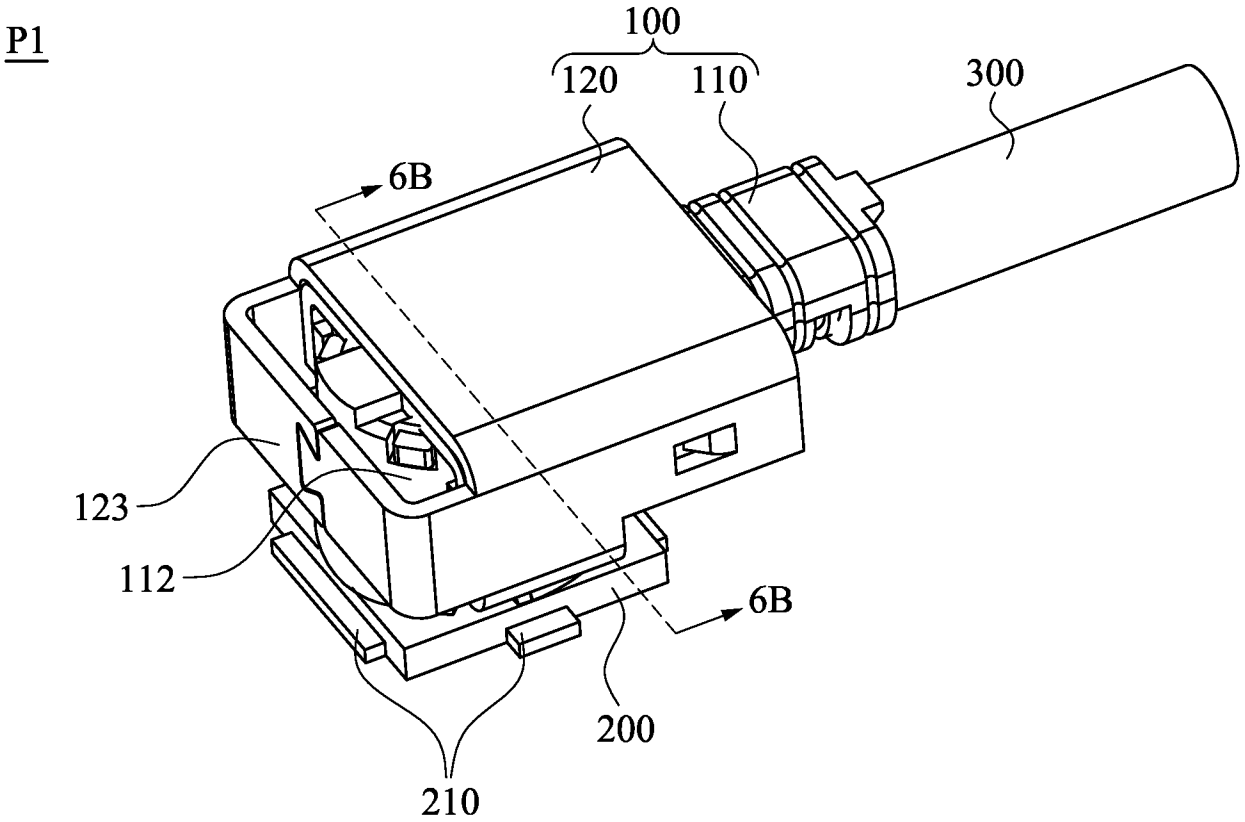
FIG. 6A is a perspective view of the electrical connector and the receptacle connector when the sliding lock element is at the first position according to an embodiment of the disclosure.
Figure 6B:
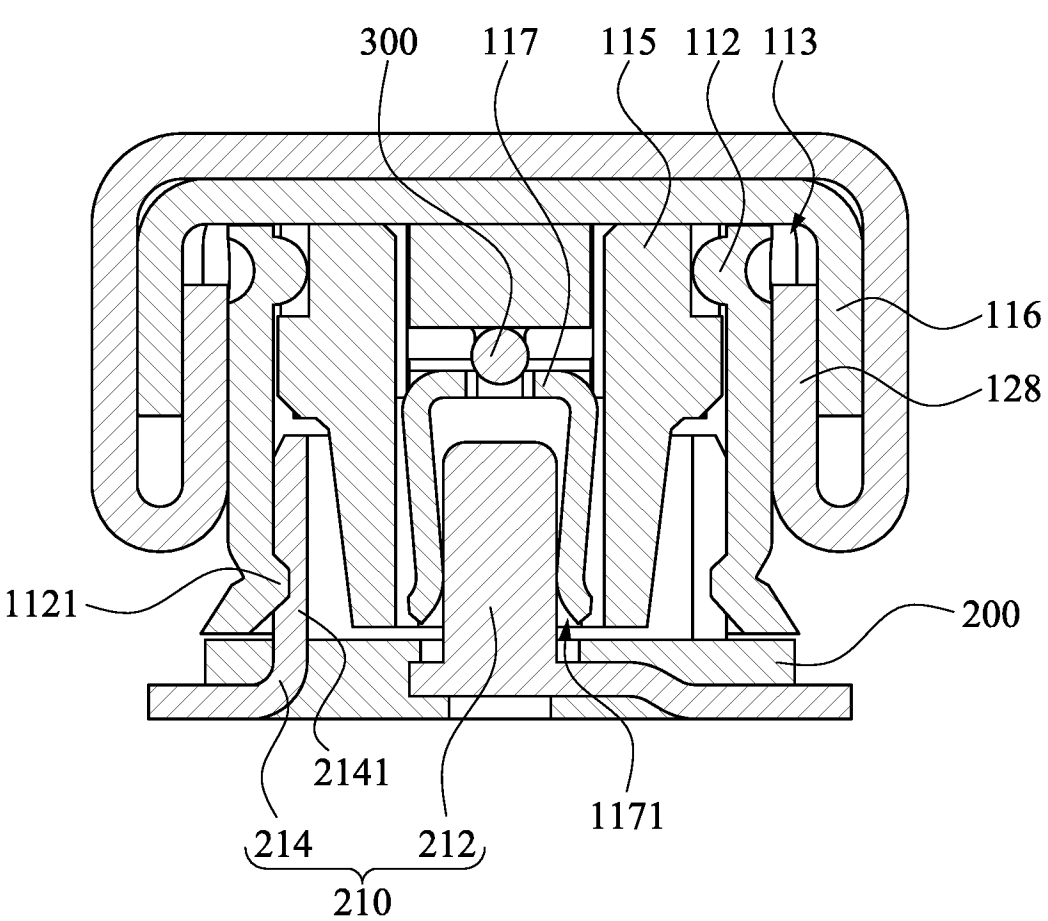
FIG. 6B is a cross-sectional view of the electrical connector and the receptacle connector taken along line 6B-6B in FIG. 6A.

Reference is made to FIGS. 6A and 6B. FIG. 6A is a perspective view of the electrical connector 100 and the receptacle connector 210 when the sliding lock element 120 is at the first position P1 according to an embodiment of the disclosure. FIG. 6B is a cross-sectional view of the electrical connector 100 and the receptacle connector 210 taken along line 6B-6B in FIG. 6A. As shown in FIG. 6A, the plug 110 is engaged to the receptacle connector 210 mounted on the substrate 200. At this time, the sliding lock element 120 is located at the first position P1 to limit the diameter expansion of the inserting portion 112 to lock the engagement of the plug 110 and the receptacle connector 210. Specifically, as shown in FIG. 6B, the receptacle connector 210 has a conductive contact 212 and a joint portion 214. The conductive contact 212 extends from an inside of the substrate 200 and protrudes out of the substrate 200. The joint portion 214 is disposed around the conductive contact 212. The joint portion 214 is made of resilient conductive material. The conductive contact 212 extends from the inside of the substrate 200 and protrudes out of the substrate 200, so as to form a part of the ground circuit with the substrate 200. An outer circumference surface of the joint portion 214 has a recess portion 2141. The recess portion 2141 is recessed toward the conductive contact 212. The recess portion 2141 extends around the outer circumference surface of the joint portion 214.

In some embodiments, a number of the recess portion 2141 is plural. In such embodiments, the plurality of recess portion are disposed at intervals on the outer circumferential surface of the joint portion 214. However, the disclosure is not limited in this regard.

In some embodiments, the receptacle connector 210 is mounted on the substrate 200 by, for example, soldering, but the disclosure should not be limited in this regard.

Continue to refer to FIG. 6B. When the plug is engaged to the receptacle connector 210, the conductive contact 212 is engaged into the accommodating space 1171 surrounded by the conductive contact 117, and the conductive contact 212 electrically contacts to the conductive contact 117. The conductive contact 212 is electrically connected to the conductive contact 117, and the conductive contact 212 forms the signal transmission circuit together with the coaxial cable 300. The joint portion 214 is located between the insulating portion 115 and the inserting portion 112. The joint portion 214 is in contact with the inserting portion 112. The joint portion 214 is electrically connected to the inserting portion 112, and the joint portion 214 forms the ground circuit together with the coaxial cable 300. Further, the convex portion 1121 of the inserting portion 112 is engaged with the recess portion 2141 of the joint portion 214 to restrict the relative movement of the plug 110 and the receptacle connector 210. At this time, the fitting portions 128 of the sliding lock element 120 are fitted between the inserting portion 112 and the first sidewall portions 116. The diameter expansion capability of the inserting portion 112 is limited. The insertion and the removal of the plug 110 relative to the receptacle connector 210 are thus locked by the sliding lock element 120.

Figure 7A:
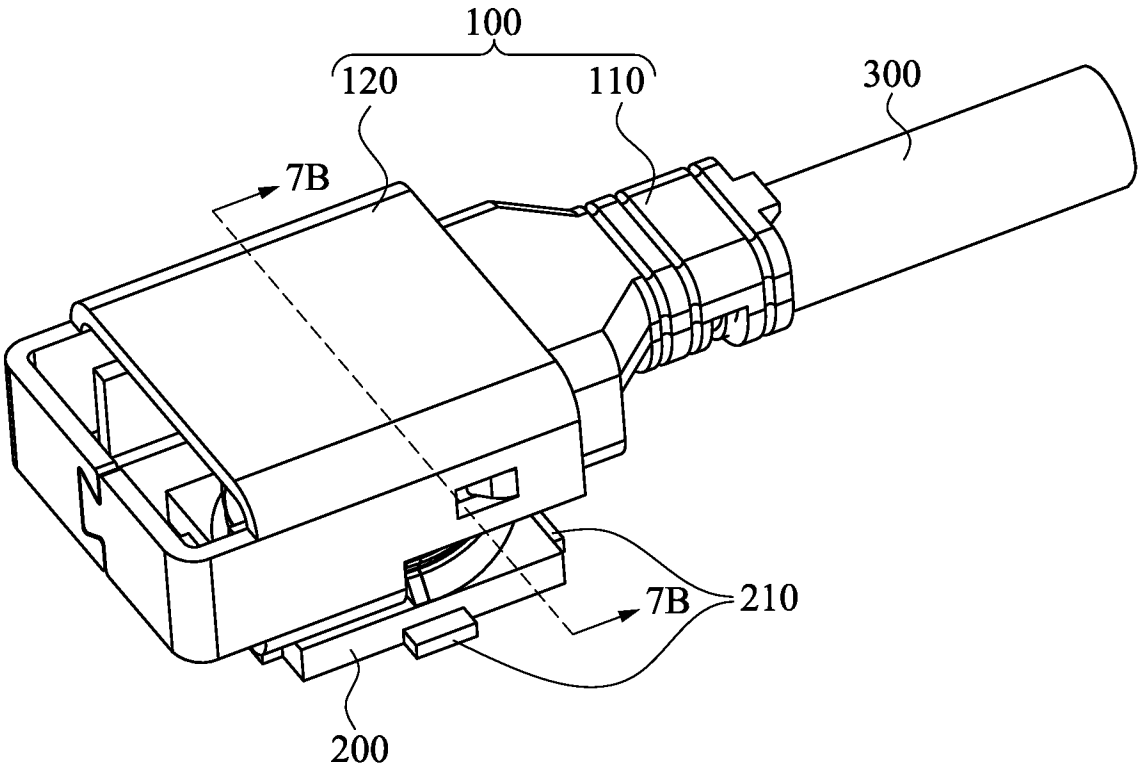
FIG. 7A is a perspective view of the electrical connector and the receptacle connector when the sliding lock element is at the second position according to an embodiment of the disclosure.
Figure 7B:
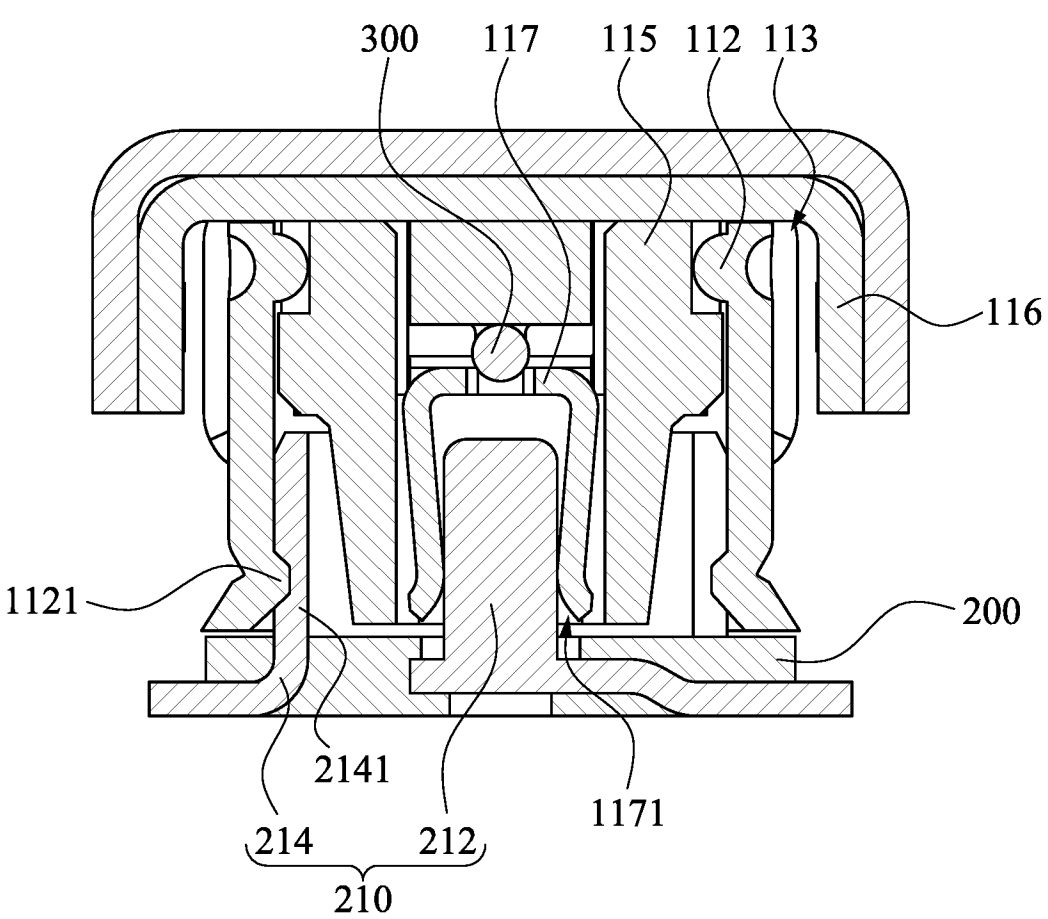
FIG. 7B is a cross-sectional view of the electrical connector and the receptacle connector taken along line 7B-7B in FIG. 7A.

Reference is made to FIGS. 7A and 7B. FIG. 7A is a perspective view of the electrical connector 100 and the receptacle connector 210 when the sliding lock element 120 is at the second position P2 according to an embodiment of the disclosure. FIG. 7B is a cross-sectional view of the electrical connector 100 and the receptacle connector 210 taken along line 7B-7B in FIG. 7A. As shown in FIG. 7A, the plug 110 is engaged to the receptacle connector 210 mounted on the substrate 200. However, the sliding lock element 120 is located at the second position P2. Therefore, the diameter expansion capability of the inserting portion 112 is not limited by the sliding lock element 120. The plug 110 can be inserted into or be removed from the receptacle connector 210. Specifically, as shown in FIG. 7B, although the convex portion 1121 of the inserting portion 112 is stilled engaged with the recess portion 2141 of the joint portion 214, the fitting portions 128 of the sliding lock element 120 have withdrawn from the gaps 113 between the inserting portion 112 and the first sidewall portions 116. As such, in this state, the inserting portion 112 can be expanded outward to move along an outer wall of the joint portion 214 relative to the joint portion 214. In other words, in this state, the plug 110 can be inserted into or be removed from the receptacle connector 210.

In some embodiments, the first position P1 does not specifically refer to a position at which the sliding lock element 120 locks the plug 110 relative to the receptacle connector 210. The second position P2 is not specifically limited to a position where the sliding lock element 120 allows the plug 110 to be inserted into or be removed from the receptacle connector 210. The disclosure should not be limited in this regard.

According to the foregoing recitations of the embodiments of the disclosure, it can be seen that in the electrical connector of the present disclosure, the diameter expansion capability of the inserting portion of the plug is restricted or is loosen by the sliding of the fitting portion of the sliding lock element. Therefore, the plug of the electrical connector can be quickly and easily assembled to the receptacle connector, and the plug is tightly engaged to the receptacle connector.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An electrical connector, comprising:

a plug comprising:

an inserting portion shaped as a cylindrical;

a cover portion covering one end of the inserting portion; and a first sidewall portion perpendicularly connected to the cover portion, wherein a gap is formed between the first sidewall portion and the inserting portion; and a sliding lock element assembled on the plug and comprising:

a lid portion slidably covering the cover portion of the plug;

a vertical extension portion perpendicularly connected to the lid portion; and a fitting portion connected to the vertical extension portion and extending toward the lid portion, wherein when the fitting portion slides with the lid portion to a first position relative to the plug, the fitting portion is fitted in the gap between the inserting portion and the first sidewall portion and being abutted to the inserting portion; and wherein the plug is configured to be located at an end of a coaxial cable and the sliding lock element slides along a direction deviating from an axis of the coaxial cable with a predetermined angle.

2. The electrical connector of claim 1, wherein the first sidewall portion comprises a guiding slot.

3. The electrical connector of claim 2, wherein the sliding lock element further comprises a first stopping portion disposed on the vertical extension portion, wherein the first stopping portion slides along the guiding slot of the first sidewall portion, when the fitting portion slides with the lid portion to a second position relative to the plug, the first stopping portion is abutted against an end surface of the guiding slot.

4. The electrical connector of claim 3, wherein the plug further comprises a second sidewall portion perpendicularly connected to the cover portion, and a distance from the second sidewall portion to a central line of the cover portion is smaller than a distance from the first sidewall portion to the central line of the cover portion.

5. The electrical connector of claim 1, wherein the sliding lock element further comprises a connected portion connected between the vertical extension portion and the fitting portion.

6. The electrical connector of claim 5, wherein the connected portion is a U-shaped structure.

7. The electrical connector of claim 1, wherein the sliding lock element further comprises a second stopping portion perpendicularly connected to the vertical extension portion, when the sliding lock element is positioned at the first position, the second stopping portion is abutted against the inserting portion.

8. The electrical connector of claim 1, wherein an end of the inserting portion away from the cover portion comprises a plurality of notches.

9. The electrical connector of claim 1, wherein the electrical connector is a high frequency electrical connector.

* * * * *